United States Patent [19]

Lotz

[11] Patent Number: 4,826,394

[45] Date of Patent: May 2, 1989

[54] VACUUM PUMP

[75] Inventor: Heinrich Lotz, Wetzlar, Fed. Rep. of Germany

[73] Assignee: Arthur Pfeiffer Vakuumtechnik Wetzlar GmbH, Asslar, Fed. Rep. of Germany

[21] Appl. No.: 146,953

[22] Filed: Jan. 22, 1988

Related U.S. Application Data

[63] Continuation-in-part of Ser. No. 38,035, Apr. 14, 1987, abandoned.

[30] Foreign Application Priority Data

Apr. 19, 1986 [DE] Fed. Rep. of Germany ..... 3613344

[51] Int. Cl.[4] ..... F01D 5/00

[52] U.S. Cl. ..... 415/72; 415/90

[58] Field of Search ..... 415/72, 90, 215, 213; 417/423 C, 199 R, 201, 203, 205

[56] References Cited

U.S. PATENT DOCUMENTS

| | | | |
|---|---|---|---|
| 3,298,314 | 1/1967 | Kopczynski | 415/72 |
| 3,697,190 | 10/1972 | Haenjens | 415/72 |

FOREIGN PATENT DOCUMENTS

| | | | |
|---|---|---|---|
| 1256281 | 5/1961 | France | 415/90 |
| 125795 | 9/1985 | Japan | 415/90 |
| 242084 | 11/1925 | United Kingdom | 415/72 |

*Primary Examiner*—Robert E. Garrett
*Assistant Examiner*—Therese M. Newholm
*Attorney, Agent, or Firm*—Toren, McGeady & Associates

[57] ABSTRACT

A turbo-molecular vacuum pump has a high vacuum side and a fore vacuum side in the form of a molecular pump in which the rotor and stator are frusto-conically shaped. The frusto-conically shaped rotor surface has a helical groove. An axial bearing for the rotor is located at an imaginary apex point of the conically-shaped surface of the rotor. The surface of the bearing containing the imaginary apex point is stationary relative to the stator. The rotor and stator are formed of a high heat conductivity material.

6 Claims, 3 Drawing Sheets

VACUUM PUMP

CROSS REFERENCE TO RELATED APPLICATIONS

This is a continuation-in-part of U.S. patent application No. 038,035 filed Apr. 14, 1987, now abandoned, in the name of Heinrich Lotz.

BACKGROUND OF THE INVENTION

The present invention relates to a vacuum pump and more particularly to a turbo-molecular vacuum pump for relatively high pressure.

Molecular pumps produce a constant pressure ratio in the region of the molecular flow and a constant pressure differential in the region of the laminar flow. In molecular pumps in the style of Gaede, Hollweck or Siegbahn, for example, with very narrow gaps, both the pressure ratio in the molecular region and the pressure differential in the laminar region are particularly high. Turbo-molecular pumps, as a further development of the molecular pumps of earlier design, with larger gaps, produce a very high pressure ratio in the molecular region, but only a small pressure differential in the laminar region.

A molecular pump of Hollweck's design is disclosed, for example, in Swiss Patent No. 222 288. The fundamental construction and the mode of operation of a turbo-molecular pump are described by W. Becker in the journal "Vakuumtechnik", No. 9/10–1966 under the title "The turbo-molecular pump." Both types of pumps are molecular pumps, that is to say, they work in the molecular flow region and the gas transport is effected by transmitting pulses from moved walls to the molecules of the gas to be conveyed.

The working range of turbo-molecular pumps is limited, however, in the direction of higher pressures because they are only fully effective in the molecular flow region. The molecular flow region is limited by the pressure at which the mean free path of the molecules drops to the order of magnitude of the dimensions of the vessel.

Turbo-molecular pumps, therefore, work only in combination with backing or fore pumps. As a rule, these are two-stage sliding-vane rotary pumps. If it were possible to shift the working range of turbo-molecular pumps in the direction of higher pressures, the expense for producing the backing or fore pressure could then be reduced. For example, single-stage sliding-vane rotary pumps would be sufficient. In other cases, oil-sealed sliding-vane rotary pumps could be replaced by dry diaphragm pumps, for example.

The working range of a turbo-molecular pump can be shifted in the direction of higher pressures by fitting a molecular pump of the Hollweck pump type following on the fore vacuum stage. Such combinations are described, for example, in DE-AS 2 409 857 and in EP 01 29 709.

It is essential for the operation of such a Hollweck pump that the spacing between the rotor and stator should be very small. Only then does it work, even at relatively high pressures, as a turbo-molecular pump still in the molecular flow range and develop its full pressure ratio which shifts the working range in the direction of higher pressures. Theory and experimental results call for spacing between the rotor and stator of a few hundredths of millimeters.

Another prerequisite for satisfactory efficiency of a molecular pump is a high speed of rotation of the rotor.

These two extreme requirements, high speed of rotation and narrow gaps, involve two conditions for the design of a molecular pump which are difficult to reconcile with one another. The higher the speed of rotation, the greater must be the minimum spacing between rotating and stationary parts, in order to prevent a collision. With very high speeds of rotation and very narrow gaps, all designs of molecular pumps hitherto known, apart from turbo-molecular pumps, represent extremely critical structural units. This applies in particular when the gap is further reduced by the thermal expansion of the rotor caused by the electric drive, friction losses and compression work. Then the rotor may run against the stator, as a consequence of which destruction of the pump may occur in many cases.

SUMMARY OF THE INVENTION

The present invention seeks to provide a vacuum pump consisting of a high vacuum side formed by a turbo-molecular pump and a fore vacuum side formed by a molecular pump constructed in the manner of a Hollweck pump. The molecular pump serving as a backing for fore vacuum side should be designed so that reliable operation is guaranteed under the extreme conditions of very narrow gaps between rotor and stator and high speeds of rotation, even in the event of expansion of the rotor, for example, through a rise in temperature. A temperature rise is also critical on the high vacuum side where stator and rotor discs are arranged in an interleaved manner.

According to a first aspect of the present invention, a molecular pump is provided made up of a rotor and an associated stator with a bearing axially locating the rotor. The rotor has a frusto-conical shape defining an imaginary apex. The truncated cone has helical grooves formed therein, and the stator has a corresponding conically shaped configuration adapted to the conical shape of the rotor, with the bearing for the rotor located at the imaginary apex, that is, at the intersection of the generatrices of the conical surfaces with the axis of the rotor. It is important that the imaginary apex is located at a stationery point relative to the stator.

Another aspect of the present invention is the provision of a turbo-molecular vacuum pump having a high vacuum side and a fore vacuum side and comprising a rotor having a stator associated therewith and a bearing axially locating the rotor, the rotor and the stator are made up of respective discs, with a part of the rotor on the fore vacuum side being formed by a truncated cone defining an imaginary apex. The truncated cone has helical grooves formed in its surfaces and the stator has a conical configuration adapted to the conical shape of the rotor, with the rotor bearing located at the imaginary apex of the truncated cone. To maintain the very narrow gap between the rotor and stator in case of expansion, it is necessary that the rotor and the stator expand uniformly. This is possible only if the temperature gradient in both parts is as small as possible when high temperatures develop. The requisite effect can be achieved if the rotor and stator are formed of a material with a high heat conductivity, such as aluminum.

The various features of novelty which characterize the invention are pointed out with particularity in the claims annexed to and forming a part of this disclosure. For a better understanding of the invention, its operating advantages and the specific objectives attained by its use, reference should be had to the drawings and descriptive matter in which there are illustrated and described the preferred embodiments of the invention.

DETAILED DESCRIPTION OF THE PREFERRED EMBODIMENTS

Figure 1:
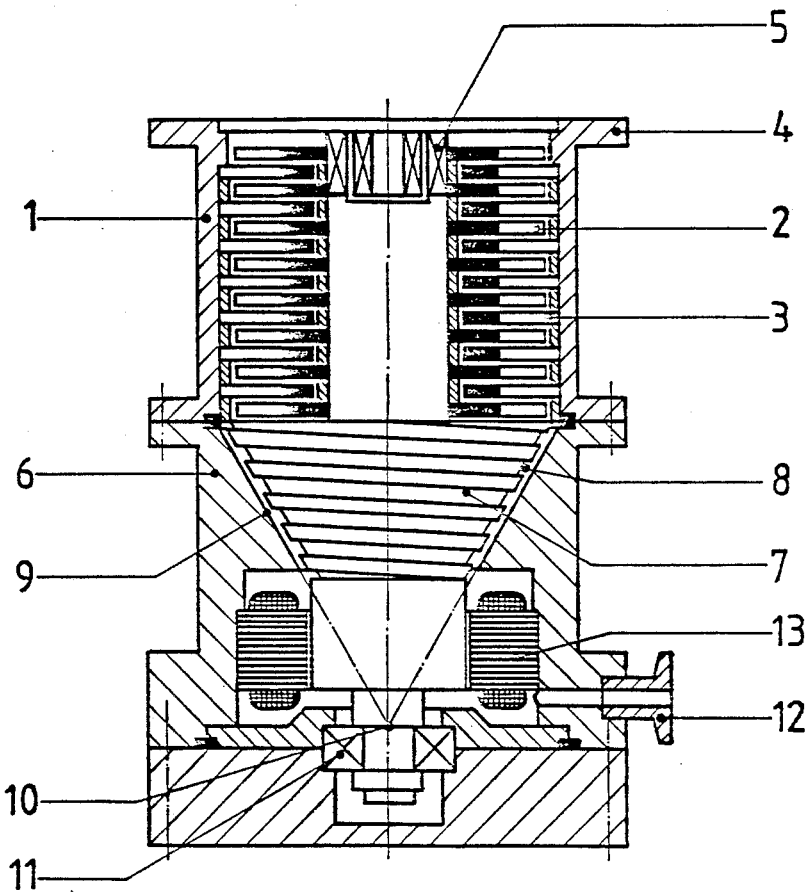
FIG. 1 is a sectional view showing a turbo-molecular pump according to a first embodiment of the present invention, wherein the apex of the cone is remote from the turbo-molecular pump stage.
Figure 2:
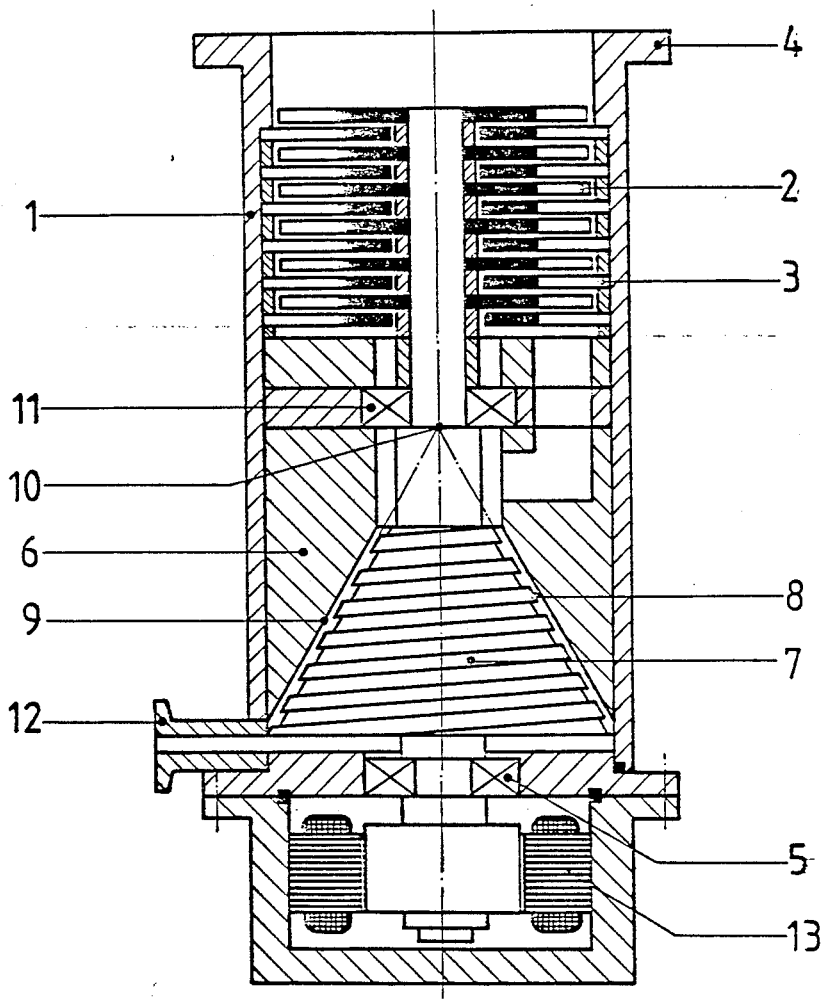
FIG. 2 is a sectional view showing a turbo-molecular pump according to a second embodiment of the present invention, wherein the apex of the cone is adjacent to the turbo-molecular pump stage.

Referring now to the drawings and particularly FIGS. 1 and 2, two different forms of the invention are illustrated which differ from one another fundamentally in that in FIG. 1, the imaginary apex of the cone of the rotor of the molecular pump is adjacent to the backing-pressure side and in FIG. 2, it is adjacent the side where the turbo-molecular pump stage is situated. Thus, in the embodiment of FIG. 2, centrifugal force effects can be utilized additionally as a pumping aid. In both embodiments the rotor is frusto-conical or truncated and the generatrices of the conical surface intersect with the rotor axis at an imaginary apex.

In the housing 1 of the turbo-molecular pump stage, there are interleaved rotor discs 2 and stator discs 3 with a narrow gap between them. At the high-vacuum side, the housing 1 is terminated by a flange 4. A bearing 5, which may be constructed in the form of a magnetic bearing, for example, serves to guide the rotor radially. This bearing 5 does not necessarily have to be fitted at the high vacuum side. If an oil-lubricated ball bearing is used, it is preferable to dispose this at the vacuum side of the turbo-molecular pump stage.

The housing of the pump combination at the vacuum side or molecular pump stage is designated as 6. The rotor of this pump stage is formed by a truncated cone 7 with helical grooves 8. The truncated cone 7 is in axial alignment with the rotor discs and stator discs 3. The associated stator consists of a cone 9 adapted to the conical shape of the rotor. The imaginary apex of the truncated cone 7 is at point 10. At this point 10, which is stationary relative to the stator, a bearing 11 is also fitted which locates the rotor axially. The backing or fore vacuum connection is designated 12 and the electric drive motor 13. The rotor 2, 7 and the stator 3, 9 are formed of a material having a high heat conductivity such as aluminum, affording uniform thermal expansion and maintaining uniform spacing between the conically shaped rotor and stator surfaces.

Figure 3:
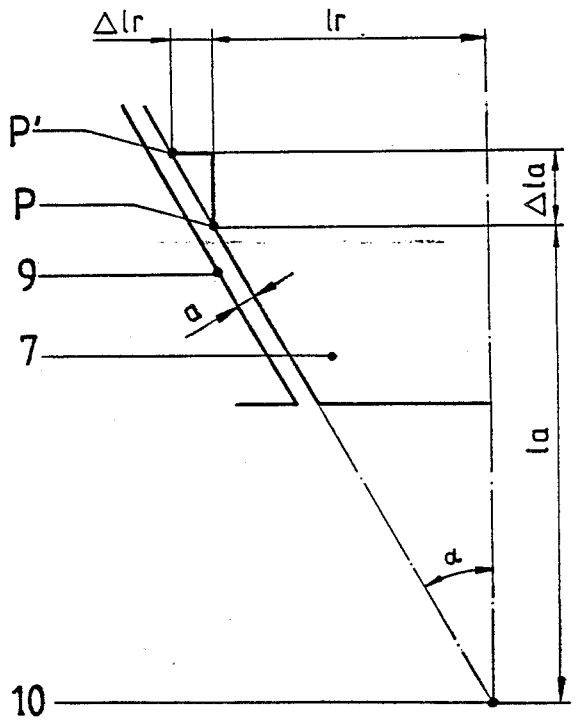
FIG. 3 is a schematic diagraph showing a detail of FIG. 1.

The geometrical relationships in the event of heat expansion of the rotor are illustrated in FIG. 3. If the rotor is axially located at the imaginary apex of the truncated cone 10, the gap width a between the rotor and stator remains constant in the event of an isotropic expansion of the rotor.

Thus, from the foregoing, it will be seen that the present invention provides a turbo-molecular vacuum pump comprising a rotor and an associated stator and having a high vacuum side with rotor discs and stator discs, the part of the rotor adjacent the fore vacuum side being formed by a truncated cone on which there are helical grooves and the stator consisting of a conical configuration adapted to the conical shape of the rotor, with the bearing which locates the rotor axially being at the imaginary apex of the truncated cone. The rotor and stator are formed of a high heat conductivity material.

As a result of the fact that the bearing of this pump combination which locates the rotor axially is at the imaginary apex of the truncated cone, the spacing between the rotor and stator of the pump stage thus formed remains constant in the event of expansion of the rotor. The changes in the spacing between the rotor discs 2 and stator discs 3 of the turbo-molecular pump stage vary, as in the known designs of turbo-molecular pumps, within the tolerance limits which are greater by about the factor 10 than in a molecular pump constructed in the manner of a Hollweck pump.

The fact that the width of the gap at the conical molecular pump remains constant in the event of expansion of the rotor, if the imaginary apex of the cone is located at a stationary point relative to the stator can be shown with reference to FIG. 3. In the event of isotropic heat expansion of the rotor:

$$\Delta lr/\Delta lr = lr/lr$$

Thus, the angle $\alpha$ remains constant and a point P on the rotor is displaced parallel to the envelope of the cone to P'.

In the example of FIG. 2, the tip or imaginary apex of the cone is at the side of the rotor adjacent the turbo-molecular pump stage. With this design, the same conditions apply for gap width a in FIG. 3. In this case, however, there is also the advantage that centrifugal force causes an additional pumping effect. On emerging from the turbo-molecular pump, the gas is drawn into the backing or fore stage with a small radius and expelled with a large radius.

The conically shaped molecular pump stage can, of course, also be used advantageously either separately or in conjunction with a different type of high vacuum pump.

The present invention also provides a molecular pump comprising a rotor and an associated stator, wherein the rotor is formed by a truncated cone on which there are helical grooves and the stator consists of a frustum of a cone adapted to the conical shape of the rotor, the bearing which locates the rotor axially being at the imaginary tip or apex of the truncated cone.

While specific embodiments of the invention have been shown and described in detail to illustrate the application of the inventive principles, it will be understood that the invention may be embodied otherwise without departing from such principles.

I claim:

1. In a molecular pump including an axially extending rotor, an axially extending stator operatively associated with said rotor, and a bearing axially locating said rotor, wherein the improvement comprising that said rotor is a frustum of a cone and has a conically shaped surface concentric with the rotor axis with generatrices of said conically-shaped surface intersecting the rotor axis at an imaginary apex point, helical grooves formed in said rotor surface, said stator has a conically-shaped surface corresponding to the conically-shaped surface of said rotor and spaced closely outwardly from said rotor, and said bearing forms a bearing surface facing the rotor and extending transversely of the rotor axis with said bearing surface being stationary relative to said stator and said imaginary apex point being located on said bearing surface.

2. In a molecular pump as set forth in claim 1, wherein said rotor and stator are formed of a material having a high heat conductivity such as aluminum affording uniform thermal expansion and maintaining uniform spacing between the conically-shaped rotor and stator surface.

3. A turbo-molecular vacuum pump having a high vacuum side and a fore vacuum side and including an axially extending rotor, an axially extending stator operatively associated with said rotor, and a bearing axially locating said rotor, said rotor and said stator each comprising a first axially extending part and a second axially extending part with said first parts having spaced interleaved discs, said second part of said rotor is a frustum of a cone and has a conically-shaped surface concentric with the rotor axis and with helical grooves formed in said rotor surface, said second part of said stator has a conically-shaped surface corresponding to the conically-shaped surface of said rotor, said bearing forms a surface facing the rotor and extending transversely of the rotor axis with said bearing surface being stationary relative to said stator, generatrices of said conically-shaped rotor surface intersect the rotor axis of an imaginary apex point and said apex point being located on said bearing surface.

4. A turbo-molecular vacuum pump, as set forth in claim 3, wherein said imaginary apex point of said rotor is remote from said high vacuum side.

5. A turbo-molecular vacuum pump, as set forth in claim 3, wherein said apex point of said rotor is located adjacent to said high vacuum side.

6. A turbo-molecular vacuum pump, as set forth in claim 3, wherein said rotor and stator are formed of a material having a high heat conductivity such as aluminum affording uniform thermal expansion and maintaining uniform spacing between the conically-shaped rotor and stator surfaces.

* * * * *